United States Patent [19]

Bisegna

[11] 4,018,381

[45] Apr. 19, 1977

[54] APPARATUS FOR INCREASING THE EFFICIENCY OF HEATING SYSTEMS FOR BUILDINGS

[75] Inventor: Frank A. Bisegna, Salem, Mass.

[73] Assignee: Red Top Fuel Company, Salem, Mass.

[22] Filed: Mar. 7, 1975

[21] Appl. No.: 556,436

Related U.S. Application Data

[63] Continuation of Ser. No. 350,940, April 13, 1973, abandoned.

[52] U.S. Cl. ..... 237/55; 98/48; 126/85 B

[51] Int. Cl.[2] ..... F24B 7/00

[58] Field of Search ..... 237/55, 81; 126/85 B, 126/307 R; 98/48; 110/147

[56] References Cited

UNITED STATES PATENTS

| | | | |
|---|---|---|---|
| 1,160,954 | 11/1915 | Parker | 126/307 R |
| 2,711,683 | 6/1955 | Ryder | 237/55 |
| 3,906,925 | 9/1975 | Dyer | 126/85 B X |

*Primary Examiner*—William E. Wayner
*Assistant Examiner*—William E. Tapolcai, Jr.

[57] ABSTRACT

Apparatus and method for reducing the flow of convection currents into and throughout the interior of a building during and after the time hot exhaust gases from the furnace are discharged through the chimney by utilizing a passage means to bring in outside air directly to the chimney without mixing it with air in the interior of the building.

2 Claims, 3 Drawing Figures

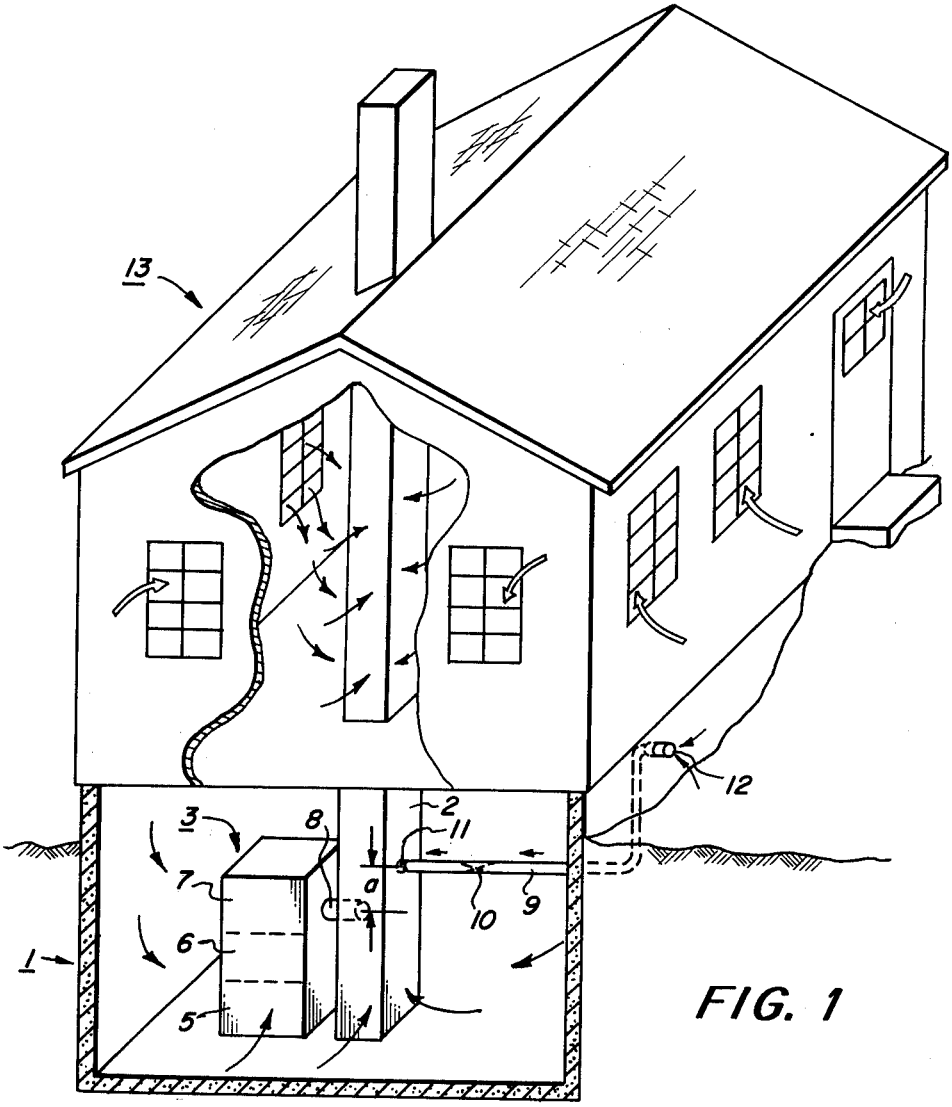
FIG. 1
FIG. 2
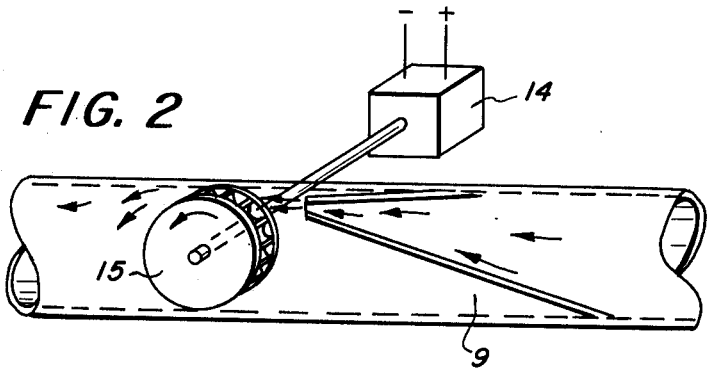

APPARATUS FOR INCREASING THE EFFICIENCY OF HEATING SYSTEMS FOR BUILDINGS

This is continuation, of application Ser. No. 350,940, filed Apr. 13, 1973, now abandoned.

BACKGROUND OF THE INVENTION

This invention relates to heating systems for buildings and, more particularly, to apparatus and method for reducing the flow of convection currents into and generally throughout the building's interior during and after the heating system is in operation.

Most modern buildings have central or zone heating systems which provide hot water during all seasons and interior heat during cold weather. The normal self-contained building heating system has a furnace, including a supply of fuel, and a chimney or other similar flue for discharging the hot exhaust gases from the furnace to the atmosphere external to the building. The fuel is fed to the furnace where it is burned and converted to heat. The heat is exchanged to the heating medium, for instance, air which is pumped from the furnace to be circulated throughout the interior of the building. The hot gases produced by the furnace are then exhausted through the chimney.

The discharge of hot exhaust gases from the furnace through the chimney is carried out through convection currents. The air that is discharged to the outside atmosphere through the chimney has been heretofore replaced by air in the interior of the building. Consequently, as this happens, the air in the interior of the building is replaced by air outside the building which seeps in through the building's exterior walls, windows, etc. In order for the chimney to work properly there must be air drawn from outside the building to replace the air drawn into the chimney from the interior of the house.

As a result there are constant convection currents of exterior air flowing into the interior of the building which tend to reduce the efficiency of the furnace in warming the interior of the building.

The present invention is a means for reducing such inefficiency caused by convection currents. The invention comprises means to gather air outside the building and feed it directly to the furnace exhaust system. This system reduces the flow of convection currents into and generally throughout the interior of the building while still providing enough convection currents to the chimney to cause the hot gases to rise up the chimney in normal fashion.

Accordingly it is an object of the invention to improve the efficiency of heating systems for building and the like.

It is a further object of the invention to improve the exhausting of hot gases through chimney systems in buildings.

It is a further object of the invention to reduce the fire hazard in chimneys.

It is a further object of the invention to improve the efficiency of building heating systems by providing a special source of outside air to the furnace exhaust system rather than relying on convection currents flowing into and generally throughout the interior of the building to supply replacement air to the chimney.

The present invention is an apparatus and method for making systems in buildings more efficient. There is provided a means for bringing air outside a building directly into the furnace exhaust system without mixing it with the air inside the building. The invention avoids the convection currents which normally pass into and generally through the interior of the building to provide replacement air in the bottom of the chimney. In one embodiment a pipe joins the chimney preferably above the furnace flue and extends to the exterior of the building where it is free to gather and bring in exterior air. The pipe can join the furnace exhaust system in the furnace flue chamber or in the chimney. The pipe which brings in exterior air can be fitted with a valve means which regulates the flow of air into the furnace exhaust system.

BRIEF DESCRIPTION OF THE DRAWINGS

For a better understanding of the invention as well as other objects and further features thereof, reference is had to the following detailed description of the invention to be used in conjunction with the accompanying drawing, wherein:

FIG. 1 is a schematic illustration of a heating system in a building utilizing the invention;

FIG. 2 is a detailed view of a second embodiment of the invention.

DESCRIPTION OF THE PREFERRED EMBODIMENTS

Figure 3:
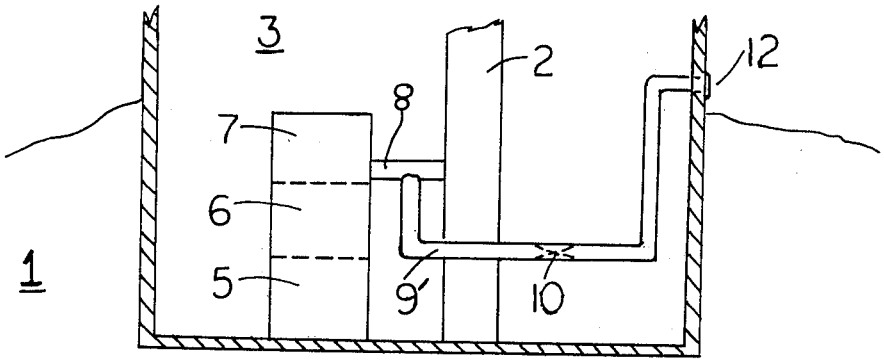
FIG. 3 is a detailed view of an alternative embodiment of this invention.

The present invention can be adapted to any enclosure having an interior source of heat which is to be exhausted to the exterior. For the purpose of this description, however, the invention will be described principally within the environment of a building in which a furnace system or boiler is utilized to produce hot water and heat so that it becomes comfortable for habitation.

FIG. 1 shows by schematic illustration a building, house 13, having its basement wall partially cut away to show heating system 1. The heating system includes a heating plant or furnace 3, connected to a source of fuel (not shown), a chimney 2 which provides an escape route for hot exhaust gases from the furnace, and an air passage means 9. When heat or hot water is required in the building, fuel is fed to the furnace 3. The fuel is ignited in fire chamber 5, shown as the lower third of the furnace, and the hot gases produced therefrom pass through boiler 6, shown as the middle third of the furnace, where hot water or some other heating medium in the boiler is heated. After passing through boiler 6, the hot gases collect in flue chamber 7, shown as the upper third of the furnace, and pass out of the furnace into chimney 2 through furnace flue 8. The hot water or other heating medium gathers heat in boiler 6 and then is circulated throughout the building to warm it or provide other useful functions.

As the hot gases pass from flue chamber 7 to furnace flue 8 and into the lower part of chimney 2, the following changes within the chimney occur which cause the hot gases to rise the full length of the chimney and into the atmosphere above the building. Before the furnace is started, air inside the chimney has the same density as the air surrounding it. However, once the furnace is operational and hot gases pass through flue 8 into the chimney, the air in the chimney above the flue is warmed and expands. As this happens, the air becomes lighter and it rises up the chimney. Meanwhile, relatively cooler air inside the house which surrounds the chimney is drawn into the chimney, as shown in FIG. 1 by the arrows; e.g., near its bottom section. The rising hot air in the chimney becomes the ascending part of a convection current while a descending part of the convection current is created in the air surrounding the chimney and is depicted by the arrows in FIG. 1.

As the chimney continues to draw, the descending part of the air currents, acting on the interior air of the house, actually draw air exterior to the building into the building, again, as shown by the arrows in FIG. 1. These convection currents constantly occur whenever the furnace passes hot exhaust gases into the bottom of the chimney and have the effect of modifying the temperature within the building. For instance, if the furnace is being used to heat the interior of the building when the temperature is lower than desired, once hot exhaust gases are introduced to the chimney from the furnace, the descending part of the convection current causes colder, outside air to pass through the walls of the building, throughout the interior and finally into the bottom part of the chimney. This effect reduces the temperature inside the building and hence the overall efficiency of the heating system.

Similarly, if the temperature outside the building is warmer than the temperature desired in the interior of the building, air conditioning or some other means for cooling the interior can be provided. However, if hot water is desired in the building, the furnace is fired up to produce it and hot exhaust gases are again introduced into the chimney making the chimney draw. This creates the ascending part of the convection current in the chimney and the complimentary descending part of the convection current in the building's interior. The warmer air outside the building is drawn in through the exterior walls passing generally throughout the interior and finally into the bottom of the chimney. This has the effect of warming up the interior of the building, due to the higher temperature outside, and hence reduces the efficiency of the air conditioning or other cooling means within the house. This happens even though the house is well insulated and well built because air must always be drawn into the chimney to feed it when it is drawing.

With the present invention, the loss of heat in the winter and the increase of heat in the summer because these convection currents are reduced. Hence, in the water, the efficiency of the furnace in keeping the interior of the building at a preset temperature is greatly increased and fuel cost saved. Likewise, the efficiency of the cooling means inside a house in the summer is also greatly increased during the time that the furnace is on and a savings in fuel is also effected.

The invention is a means to introduce air exterior to the building directly to the exhaust of the furnace. Such air can be introduced to the chimney 2 or to the furnace flue chamber 8. It is believed that the efficiency of the heating (or cooling) system is increased due to the mixing of the outside air with the hot exhaust gases in the chimney. Regardless of whether the outside air is very hot or very cold, the furnace discharge gases are always a good deal hotter than the atmospheric temperature outside the house. For instance, in an ordinary one-family dwelling, the usual furnace will have exhaust temperatures of approximately 350° to 1000° fahrenheit. Because the furnace exhausts are so much higher than that of the atmosphere outside, the draft produced on the chimney by the furnace exhaust gases is always very great. It has been found that by use of the present invention, an already heated house will be maintained at the desired temperature with running the heating system as little as 50% of time it runs without the invention.

In FIG. 1 the means for gathering and bringing the exterior or outside air into the bottom of the chimney is pipe 9. The pipe, which may be any convenient diameter, e.g., as 6 inches, can operatively connect with the chimney in the vicinity of its lower portion. The pipe bringing in outside air can also operatively connect directly into flue chamber 7 or furnace flue 8, as shown in FIG. 3 as 9 inches, which connects the furnace to the chimney. It has been found preferable to connect pipe 9 to the chimney itself above furnace flue 8. This is because the hot gases entering the chimney from furnace flue 8 will expand the air above the flue first and the full effect of the air entering from pipe 9 can be felt immediately. It has been found that when pipe 9 is connected to the chimney at a point above the entrance of flue 8 it performs better than when connected below. It is also preferable to avoid lacing pipe 9 in direct alignment on the same longitudinal axis with furnace flue 8, because there may be a tendency for the pipe to act as a chimney, particularly when the chimney 2 was still cold.

For best operating results, it is believed that pipe 9 should be operatively connected to the chimney so as to introduce outside air to the chimney at a minimum distance above furnace flue 8. This distance, shown by the letter *a*, can be described as at least the width as furnace flue 8 as measured along the longitudinal axis of the chimney 2. However, air passage 9 could connect with chimney 2 anywhere in the lower portion of the chimney and still operate.

Valve means 10 can also be provided in the pipe 9 to regulate the flow of air through pipe 9 for best chimney efficiency. Another variation is placing filter means 11 and 12 on both ends of pipe 9 to keep the air passage free of blocking residue. Preferably, pipe 9 should gather exterior air in the lower part of the building. This is believed exceedingly helpful in very tall buildings since the draft is further enhanced in these buildings by constant winds at the chimney top which cause a vacuum and better drawing ability on the high chimney. Keeping the air intake of pipe 9 at ground level will keep the air flowing through pipe 9 to the chimney.

As shown in FIG. 2, pipe 9 may be throated, such as with a venturi type structure, to increase the velocity of air flow. When this is done, a mechanism can be placed between the throat and the chimney to convert air flow to electrical energy. Such a device may include an air wheel 15 which will rotate due to the flow of air over the top of it on its way to the chimney. The air wheel is mechanically connected to a generator 14 to produce electrical energy which, in turn, can be used to run electric appliances, especially those with relatively modest electrical needs.

The present invention as herein described can be applied to any enclosure which requires that hot gases be exhausted to reduce heat loss. One common example is a room heated by a fireplace. The invention has particular application in areas which are required to be dust-free, because it keeps convection currents at a minimum in such areas. The invention can be in furnace systems which have flues or chimneys in non-vertical dispositions. The air passage means can gather air anywhere outside that portion of the building in which convection currents are to be avoided and does not necessarily have to be outside the building.

In addition to the apparatus outlined above many modifications and additions to this invention will be readily apparent to those skilled in the art upon reading this disclosure, and these are intended to be encompassed within the invention disclosed and claimed herein.

What is claimed is:

1. Apparatus for reducing convection currents into and throughout the interior of a building having a furnace comprising a flue for discharging hot furnace gases to the outside of the building during and after the furnace is in operation, said flue having a need for replacement air as hot furnace gases are discharged, at least a portion of said replacement air being obtainable by the flue directly from the air filling the interior of the building, and passage means for bringing air located outside the building into the flue adjacent to the location where the hot exhaust gases enter the flue, said flue comprising a furnace flue and a chimney and said chimney having a furnace end and an exterior end, said passage means being operatively connected to the chimney in the vicinity of the location where the furnace flue is operatively connected to the chimney between the place where the furnace flue is operatively connected to the chimney and the exterior end of the chimney, the distance between the locations where the passage means and furnace flue are operatively connected to the chimney is at least equal to the width of the furnace flue measuring in the direction parallel with the longitudinal axis of the chimney.

2. The apparatus according to claim 1 wherein the passage means includes a throat to increase the velocity of the air flowing to the flue, an air wheel means in the passage means adjacent the throat and generator operatively connected to the air wheel means to convert the movement of the air wheel to electrical energy.

* * * * *